United States Patent [19]

Uesugi et al.

[11] Patent Number: 4,851,091

[45] Date of Patent: Jul. 25, 1989

[54] PROCESS FOR PRODUCING SUPPORT FOR LITHOGRAPHIC PRINTING PLATE

[75] Inventors: Akio Uesugi; Kazutaka Oda; Tsutomu Kakei, all of Shizuoka, Japan

[73] Assignee: Fuji Photo Film Co., Ltd., Kanagawa, Japan

[21] Appl. No.: 359

[22] Filed: Jan. 5, 1987

[30] Foreign Application Priority Data

Jan. 9, 1986 [JP] Japan ..... 61-1288
Feb. 24, 1986 [JP] Japan ..... 61-37322

[51] Int. Cl.[4] ..... C25F 3/02; B24B 1/00; B41M 5/00; B44C 1/22

[52] U.S. Cl. ..... 204/129.46; 51/319; 51/322; 101/463.1; 156/645; 156/665; 156/905

[58] Field of Search ..... 204/129.46, 129.35, 204/33; 51/319, 322; 156/645, 665, 905; 101/463.1

[56] References Cited

U.S. PATENT DOCUMENTS

| | | | |
|---|---|---|---|
| 3,691,030 | 9/1972 | Stroszynski | 51/319 X |
| 4,183,788 | 1/1980 | Fromson et al. | 101/463.1 X |
| 4,324,841 | 4/1982 | Huang | 156/665 X |
| 4,555,872 | 12/1985 | Yie | 51/321 X |
| 4,575,396 | 3/1986 | Matsumoto et al. | 51/321 X |
| 4,613,413 | 9/1986 | Uesugi et al. | 204/33 |

*Primary Examiner*—Donald R. Valentine
*Attorney, Agent, or Firm*—Sughrue, Mion, Zinn, Macpeak, and Seas

[57] ABSTRACT

A process for producing a support for a lithographic printing plate is disclosed, comprising mechanically graining a sheet for the support with abrasive grains which have sharp-angled tips having a radius of not more than 20 μm. The process is suitable for mass production, and the lithographic printing plate produced from the resulting support is excellent in stain-resistance and printing durability.

18 Claims, No Drawings

PROCESS FOR PRODUCING SUPPORT FOR LITHOGRAPHIC PRINTING PLATE

FIELD OF THE INVENTION

This invention relates to a process for producing a support for lithographic printing plates, and, more particularly, to a process for graining an aluminum support for lithographic printing plates.

BACKGROUND OF THE INVENTION

In the field of lithographic printing plates, socalled presensitized (PS) plates comprising an aluminum support having provided thereon a light-sensitive layer composed of a light-sensitive composition have hitherto been employed. The aluminum support to be used generally has a surface roughened by various processes hereinafter described. If necessary, the roughened surface is subjected to etching with an acid or alkali aqueous solution, followed by anodic oxidation, and further followed, if desired, by surface treatment for rendering the aluminum surface hydrophilic, to thereby produce a support for a lithographic printing plate. A light-sensitive layer is provided on the support to form a presensitized lithographic plate, which is then subjected to exposure to light, development, retouching, gumming, etc., to produce a printing plate. The resulting printing plate is mounted on a printing machine to carry out printing.

The processes for surface roughening as above referred to include mechanical processes, such as ball graining, wire graining, brush graining, liquid honing, etc., an electro-chemical process called electrolytic graining, a chemical process, and a combination of two or more of these techniques. However, each of these techniques has respective disadvantages, such as set forth below.

In the case of ball graining, high skill is required for selection of the kind of material and the size of balls, control of a water content in carrying out abrasion, determination of the abrasion time, and evaluation of the finished surface, particularly as characteristic of the nature of a batch system. Besides, productivity of the ball graining process is very low.

In the case of wire graining, the roughness of the resulting surface of the aluminum plate is non-uniform. In the case of brush graining, high roughness cannot be obtained, and the grained surface tends to show scatter in roughness due to wear of the abrasive brush used. Further, the strong friction between the brush and the abrasive and the aluminum plate causes complicated scratches on the aluminum surface to form many sharp projections like molding flash. These projections cause problems, such that the light-sensitive layer of the presensitized printing plate that should be removed by development is likely to remain to some extent, causing stains on the plate face, and that scratches are easily formed on the aluminum surface through rubbing or sliding upon handling of the supports.

In the case of liquid honing, in which a slurry liquid having dispersed therein a fine abrasive powder is sprayed onto the aluminum plate at a high rate by compressed air, etc., the fine abrasive powder easily sticks to the aluminum surface to thereby form projections. Further, the surface roughness cannot be increased to a fully satisfactory extent because of the low impulsive force of the slurry liquid against the aluminum surface. Another disadvantage of this technique is that the jet nozzle wears significantly because the slurry liquid is jetted at a high rate.

When the electro-chemical process is employed for surface roughening, it is necessary to strictly control electrolysis conditions so as to maintain the surface roughness attained constant. Further, this technique not only involves a rather large consumption of electric energy, but also entails great cost for disposal of the waste liquor containing Al ions accumulated in the electrolyte. Finally, the chemical roughening process is not suitable for mass production because the time required for treatment is relatively long, and also great expenses are incurred in disposal of the waste liquor similarly to the case of the electro-chemical process.

In an attempt to overcome some of the above-described disadvantages associated with the graining process, there have been proposed an improved process comprising a combination of the brush graining or wire graining and the electrolytic graining as disclosed in U.S. Pat. No. 2,344,510 and Japanese Patent Application (OPI) Nos. 123204/78, 145701/78, and 63902/79 (the term "OPI" as used herein means "unexamined published application"), and an improved process comprising a combination of the liquid honing and the electrolytic graining as disclosed in Japanese Patent Application (OPI) No. 19593/85. According to such combined processes, however, when the brush graining is adopted as a first step, i.e., a mechanical graining step, stains are apt to be formed in the non-image areas during printing, and when the wire graining is adopted as the first step, the printing plate has poor printing durability. In the case of using liquid honing as a first step, the resulting printing plate, though exhibiting resistance to stains, is still not fully satisfactory in printing durability, thus leaving room for further improvements in order to satisfy the market requirements for more excellent qualities.

SUMMARY OF THE INVENTION

One object of this invention is to provide a process for producing a support for lithographic printing plates having excellent resistance to stains and sufficient printing durability.

Another object of this invention is to provide a process for producing a support for lithographic printing plates, which process is suitable for mass production.

The inventors have noted the shape of abrasive grains used for mechanical graining in the above-described combined roughening process. As a result of extensive studies, it has now been found that use of abrasive grains having sharp tips having a radius of 20 μm or less forms a support for lithographic printing plates excellent in printing durability and resistance to stains.

Attention was also devoted to the specific gravity of the abrasive grains to be used in the above-described mechanical graining. As a result of further investigations, the inventors have also found that the effect of the invention can be enhanced by using abrasive grains having the above-specified sharpness and also a specific gravity of not less than 2.5.

The present invention relates to a process for producing a support for a lithographic printing plate which comprises mechanically graining a sheet for the support with an abrasive material containing abrasive grains which have sharp tips having a radius of not more than 20 μm.

The present invention further relates to a process for producing a support for a lithographic printing plate which comprises mechanically graining a sheet for the support with an abrasive material containing abrasive grains which have sharp-angled tips having a radius of not more than 20 μm, and which have a specific gravity of not less than 2.5.

The present invention furthermore relates to a process for producing a support for a lithographic printing plate which comprises the step of mechanical graining comprising jetting a high-pressure liquid from at least one nozzle at a high rate, joining the jetted stream with a slurry containing the above-described abrasive grains spouted from at least one spout, and directing the resulting mixed stream to strike against a surface of a support, followed by at least one of chemical etching and electrochemical graining.

DETAILED DESCRIPTION OF THE INVENTION

Aluminum sheets are generally used as a base material for the support of lithographic printing plates. The aluminum sheets to be used include a pure aluminum sheet as well as an aluminum alloy sheet. The aluminum alloy may be composed of aluminum as a main component and small amounts of silicon, copper, iron, manganese, magnesium, chromium, zinc, lead, bismuth, nickel, etc. In any case, the aluminum preferably has a purity of 99.9% by weight or more.

The following description is particularly directed to surface roughening of the aluminum sheet, but the present invention is also applicable to other metal sheets, such as zinc, iron, etc.

The aluminum sheets for lithographic printing plates generally have a rectangular shape in their relation to a printing machine, but the material of interest in the present invention can be in the form of a continuous sheet (hereinafter also referred to as the web form) until it is cut into rectangles, particularly in the case of mass production. Whether the process of the invention is carried out on the aluminum sheet when its form is a rectangle or a continuous web is determined according to the particular case. The thickness of the aluminum sheet is generally appropriately selected in the range of from 0.1 to 0.5 mm according to tensile strength, resistance, elongation, bending strength, etc. required in the particular application of the lithographic printing plate to a printing machine.

The mechanical graining for roughening a surface of the aluminum sheet can be carried out by various methods. In view of productivity, the mechanical graining is advantageously effected by liquid honing, in which a highpressure liquid is joined with a slurry liquid, and the joined stream is directed to strike against a surface of the aluminum sheet.

The apparatus for carrying out liquid honing comprises at least one nozzle connected to a feeder of the high-pressure liquid and a spout connected to a feeder of the abrasive slurry, said nozzle(s) and spout being arranged so that the slurry spouted from the latter is joined with the stream of the high-pressure liquid jetted from the former. In case of using plural nozzles for jetting the high-pressure liquid, they may be provided around the spout for the abrasive slurry.

The feeder for the high-pressure liquid has various embodiments including, for example, a container containing a liquid kept at a high pressure, and a system composed of a container containing a liquid at atmospheric pressure and a pressure pump connected to the container. In any jetting embodiment, it is necessary that the liquid be jetted from the nozzle(s) at a flow rate of from 31 to 140 m/sec., and preferably from 70 to 120 m/sec. The liquid pressure for attaining such a flow rate is generally from 5 to 100 kg/ $cm^2$, and preferably from 30 to 50 kg/$cm^2$.

If desired, the high-pressure liquid may contain an acid or an alkali.

The feeder for the abrasive slurry essentially comprises a container for the slurry, and, desirably, a means for stirring the slurry to prevent setting of solids. Such a stirring means includes a propeller stirrer inserted in the container and a system of circulating the slurry. Constant movement of the slurry by the stirring means prevents precipitation of the solids in the slurry. The container is connected to the spout via a tube, e.g., a pressure-resisting hose, and a pump for spouting the slurry is provided in the middle of the connecting tube. The feeder for the abrasive slurry having the above-described construction feeds the slurry in a stirred state to the spout through the connecting tube by means of the pump, to thereby spout the abrasive slurry from the spout. The spouting rate of the slurry is generally from about 2 to about 25 m/sec.

The slurry comprises water and a fine powder of an abrasive. The fine powder abrasive is generally used at a concentration of from about 5 to about 80% by weight, and preferably from 30 to 50% by weight, in the slurry. If desired, the slurry may further contain an acid or an alkali.

Abrasives which can be used in this invention are grains which have sharp-angled tips having a radius of not more than 20 μm, and preferably having a specific gravity of not less than 2.5. In particular, those which always have sharp-angled tips even when destroyed (e.g., fragmented) are preferred. For example, abrasive grains having an Si content of 8% by weight or more easily retain sharp-angled tips even after being destroyed. The grains preferably have a particle size of from about #20 to about #600 as determined according to JIS R6001.

The terminology "sharp-angled tips having a radius of not more than 20 μm" as used herein for the abrasive grains means that typical sharp-angled tips of individual abrasive grains have an average radius of curvature of not more than 20 μm.

The stream of the slurry is accelerated by the stream of the high-pressure liquid to strike against the surface of the aluminum sheet. The angle of the striking stream against the aluminum sheet preferably ranges from about 15° to about 165°, and more preferably from 30° to 150°.

Because of the sharpness of the abrasive grains, the thus obtained support has sharp-cut bottoms in its roughened surface and thus exhibits satisfactory water-retention properties. If abrasive grains having sharp tips and also a specific gravity of 2.5 or more are used, the resulting support exhibits improved resistance to stains and improved printing durability since the roughness becomes deeper to enhance adhesion to a light-sensitive layer.

The thus obtained support may be coated with a light-sensitive composition to form a presensitized printing plate, but is preferably subjected to chemical etching and/or electro-chemical graining. When it is desired to uniformly conduct the electro-chemical graining hereinafter described, the electro-chemical graining is preferably preceded by the chemical etching.

The chemical etching is usually carried out using an alkali. Solutions capable of etching aluminum, such as acids, e.g., hydrofluoric acid, phosphoric acid, sulfuric acid, etc., may also be employed. Examples of the alkali which can be used preferably include sodium hydroxide, potassium hydroxide, sodium metasilicate, sodium carbonate, sodium aluminate, sodium gluconate, etc. The etching is preferably carried out at a temperature of from room temperature to 90° C. for a period of from 5 seconds to 5 minutes with an etching solution having a concentration of from 1 to 50% by weight until from 0.1 to 10 g/m$^2$ of aluminum is etched.

Since the thus alkali-etched aluminum surface contains unetched, alkali-insoluble substances (i.e., smut), the aluminum sheet should be subjected to desmutting treatment with an acidic solution, e.g., an aqueous solution of nitric acid, sulfuric acid, or phosphoric acid.

If desired, the etched aluminum sheet is subsequently subjected to electro-chemical graining. The electrolyte to be used in electrolysis for the electro-chemical graining preferably includes hydrochloric acid, nitric acid, and a mixture thereof. The electrolysis can be carried out as described in U.S. Pat. No. 4,087,341 in an electrolyte having a concentration of from 0.1 to 10% by weight, and preferably from 0.3 to 3% by weight, using a direct or alternating current. Thus, a second roughness is formed on the aluminum surface in proportion to the amount of electricity applied. The second roughness (i.e., pits formed in the originally pitted surface) has a pit depth of from 0.1 to 1 μm, and preferably from 0.1 to 0.8 μm, and a pit diameter of from 0.1 to 5 μm, and preferably from 0.1 to 3 μm.

The formation of pits having the above-recited diameter is advantageously effected by using a special alternating current having a specific wave form as described in U.S. Pat. No. 4,087,341. According to this technique, the second roughness can be economically and uniformly formed by controlling the electrolytic wave form. Further, the electrolyte may contain amines, gluconic acid, boric acid, phosphoric acid, hydrofluoric acid, etc., as described in U.S. Pat. Nos. 3,963,564 and 3,980,539.

It is preferable that the aluminum sheet having the second roughness thus formed is subsequently treated with an acid or alkali solution. Specific examples of useful acids include sulfuric acid as described in Japanese Patent Publication No. 11316/81, phosphoric acid, and a mixture of phosphoric acid and chromic acid. On the other hand, the alkali treatment comprises lightly etching the surface with an alkaline solution, such as a sodium hydroxide aqueous solution as described in Japanese Patent Publication No. 28123/73, to remove smut that may be stuck to the surface. In case of the alkali treatment, since the alkali-insoluble matter remains on the etched surface, the aluminum sheet should be subjected to desmutting with an acid solution, e.g., sulfuric acid, phosphoric acid, chromic acid, etc.

The aluminum sheet having a mechanically grained surface or the aluminum sheet having been further subjected to electro-chemical graining may he used as produced as a support for presensitized lithographic printing plates, but, for the purpose of ensuring stability with time of a diazo compound present in the light-sensitive layer formed on the support, improving adhesion to the light-sensitive layer, or improving printing durability, an intermediate layer may be provided between the support and the light-sensitive layer, or an anodic oxidation film may be formed on the aluminum sheet.

The intermediate layer as above-referred to includes a silicate layer which is formed by soaking in an aqueous solution of an alkali metal silicate, e.g., sodium silicate, as described in U.S. Pat. Nos. 2,714,066 and 3,181,461, and a hydrophilic subbing layer composed of, for example, carboxymethyl cellulose, polyvinyl alcohol, etc.

The anodic oxidation is preferably preceded by alkali etching and desmutting treatment. The electrolyte that can be used for the anodic oxidation includes not only sulfuric acid, but also phosphoric acid, chromic acid, oxalic acid, benzenesulfonic acid, etc. An anodic oxidation film is preferably formed in a thickness of from 0.1 to 10 g/m$^2$, and more preferably from 0.3 to 5 g/m$^2$. The conditions for anodic oxidation vary depending on the electrolyte used and are not, therefore, particularly limited. In general, the anodic oxidation is suitably carried out in an electrolytic solution at a concentration of from 1 to 80% by weight, at a temperature of from 7 to 70° C., at a current density of from 0.5 to 60 A/dm$^2$, at a voltage of from 1 to 100 V, and for a period of from 10 seconds to 5 minutes.

The grained aluminum sheet having the thus formed anodic oxidation film, as satisfactorily stable and hydrophilic in itself, can be directly coated with a lightsensitive composition, or, if desired, may be subjected to an additional surface treatment prior to the coating, such as formation of the above-described silicate layer composed of an alkali metal silicate, or formation of a subbing layer composed of a hydrophilic high polymer. The subbing layer is preferably formed to a thickness of from 5 to 150 mg/m$^2$.

Onto the aluminum support according to the present invention, a conventionally known light-sensitive layer is formed to obtain a presensitized lithographic printing plate precursor, which is then exposed to light and developed to produce a lithographic printing plate.

This invention will now be illustrated in greater detail with reference to the following examples, but it is to be understood that they are not intended to limit the present invention. In these examples, all of the percentages are given by weight unless otherwise indicated.

EXAMPLE 1

A water slurry containing 40% by volume of new abrasive grains of fused alumina having a particle size of #120, and sharp-angled tips having a radius of not more than 20 μm was spouted to join with a water stream jetted from nozzles fixed at 20-millimeter intervals at a pressure of 25 kg/cm$^2$, and the mixed stream was directed to strike against a surface of a JIS 1050 aluminum web (300 mm in width) at an angle of 45° (the angle of incidence to the movement of the aluminum web) in a continuous system. Then, the aluminum web was again subjected to the same liquid honing as described above except for changing the striking angle of 135°. The average center-line roughness of the resulting aluminum sheet was 0.55 μm as determined by the method of JIS BO601 (1982).

The resulting aluminum sheet was soaked in a 2.5% sodium silicate (No. 3) aqueous solution (70° C.) for 20 seconds. The resulting support was designated as Support A.

COMPARATIVE EXAMPLE 1

Support B was produced in the same manner as described in Example 1 except for using abrasive grains with round tips resulted from 500 strikes of the abrasive grains as used in Example 1 against an aluminum sheet. The resulting aluminum support had an average center-line roughness of 0.52 μm.

EXAMPLE 2

An Fe-based abrasive containing 25% Si, 0.5% C, and 10% Cr was found and adjusted to a particle size of #120 to prepare sharp-tipped abrasive grains having tips of 20 μm or less in radius.

Support C was produced in the same manner as described in Example 1 except for using the thus prepared abrasive grains. The resulting support had an average center-line roughness of 0.56 μm.

EXAMPLE 3

Support D was produced in the same manner as described in Example 1 except for using the same abrasive grains as used in Example 2 after they were made to strike against an aluminum sheet 500 times. The resulting support had an average center-line roughness of 0.57 μm.

Each of Supports A to D was coated with a lightsensitive composition having the following formulation to a dry coverage of 2.5 g/m$^2$ to form a light-sensitive layer.

| Light-Sensitive Composition Formulation: | |
|---|---|
| Ester compound formed between naphthoquinone-1,2-diazido-5-sulfonyl chloride, pyrogallol, and an acetone resin (as described in Example 1 of U.S. Pat. No. 3,635,709) | 0.75 g |
| Cresol Novolak resin | 2.00 g |
| Oil Blue #603 (an oil-soluble blue dye produced by Orient Kagaku K.K.) | 0.04 g |
| Ethylene dichloride | 16 g |
| 2-Methoxyethyl acetate | 12 g |

Each of the thus prepared presensitized printing plate precursors was exposed to light emitted from a 3 KW metal halide lamp from a distance of 1 m for 50 seconds through a transparent positive film in a vacuum printing frame. The exposed plate was then developed with a 5.26% aqueous solution of sodium silicate ($SiO_2/Na_2O$ molar ratio=1.74; pH=12.7), thoroughly washed with water, and then gummed.

Each of the resulting printing plates was mounted on a printer, "Sprint 25" manufactured Komori Insatsuki K.K.), to carry out printing. The shape and tip radius of the abrasive used, the shape of the roughness bottom observed by an electron microscope, and the results of printing are shown in Table 1 below.

TABLE 1

| | Example 1 | Comparative Example 1 | Example 2 | Example 3 |
|---|---|---|---|---|
| Support No. | A | B | C | D |
| Abrasive: | | | | |
| Shape | sharp-angled | round tips | sharp-angled | sharp-angled |
| Tip Radius | <20 μm | >20 μm | <20 μm | <20 μm |
| Roughness Bottom Shape | sharp-cut | rounded | sharp-cut | sharp-cut |
| Printing Durability | 35,000 prints | 5,000 prints | 35,000 prints | 35,000 prints |
| Appearance of Prints (Gloss*) | 4.8 | 10.8 | 4.6 | 4.9 |
| Stain-Resistance of Prints** | good | poor | good | good |

Note:
*Measured at a reflection angle of 60° by means of a glossmeter "VG-10" manufactured by Nippoin Denshoku K.K.
**"good" indicates no problem for practical use. "poor" indicates that the prints are of no practical use due to stains.

It can be seen from Table 1 that the lithographic printing plates produced by using abrasive grains having a sharp-angled tips having a radius of not more than 20 μm are excellent in resistance to stains and printing durability.

EXAMPLES 4 TO 6 AND COMPARATIVE EXAMPLE 2

Each of Supports A to D as prepared in the foregoing examples was washed with water and dipped in a 10% aqueous solution of sodium hydroxide heated at 70° C. to effect chemical etching until 6 g/m$^2$ of aluminum was etched. After washing with water, the aluminum sheet was dipped in a 30% aqueous solution of nitric acid for 1 minute for neutralization, followed by thoroughly washing with water.

The aluminum sheet was then subjected to anodic oxidation in a 20% sulfuric acid aqueous solution using a direct current so as to form an anodic oxidation film having a thickness of 1.5 g/m$^2$. After washing with water, the sheet was dipped in a 2% sodium silicate aqueous solution at 70° C. for 1 minute, washed with water, and dried.

The thus obtained support was designated as Support E, F, G, or H, respectively. Each of these supports was coated with a light-sensitive composition having the following formulation to a dry coverage of 2.0 g/m$^2$ to form a light-sensitive layer.

| Light-Sensitive Composition Formulation: | |
|---|---|
| N—(4-Hydroxyphenyl)methacrylamide/2-hydroxyethyl methacrylate/acrylonitrile/methyl methacrylate/methacrylic acid copolymer (15/10/30/38/7 by mole; average molecular weight = 60,000) | 5.0 g |
| Hexafluorophosphate of a condensate between 4-diazodiphenylamine and formaldehyde | 0.5 g |
| Phosphorous acid | 0.05 g |
| Victoria Pure Blue BOH (a dye manufactured by Hodogaya Chemical Co., Ltd.) | 0.1 g |
| 2-Methoxyethanol | 100 g |

The resulting presensitized printing plate precursor was exposed to light emitted from a 3 KW metal halide lamp from a distance of 1 m for 50 seconds through a transparent negative film in a vacuum printing frame. The exposed plate was then developed with a developer having the following formulation, followed by gumming with an aqueous solution of gum arabic to obtain a lithographic printing plate.

| Developer Formulation: | |
|---|---|
| Sodium sulfate | 5 g |
| Benzyl alcohol | 30 g |

-continued

| Developer Formulation: | |
|---|---|
| Sodium carbonate | 5 g |
| Sodium isopropylnaphthalenesulfonate | 12 g |
| Pure water | 1,000 ml |

The thus prepared lithographic printing plate was used for printing in a usual manner, and the results obtained are shown in Table 2 below.

TABLE 2

| | Example 4 | Comparative Example 2 | Example 5 | Example 6 |
|---|---|---|---|---|
| Support No. | E | F | G | H |
| Printing Durability | 100,000 prints | 50,000 prints | 100,000 prints | 100,000 prints |
| Stain-Resistance of Prints | good | poor | good | good |

The results of Table 2 demonstrate the effect on printing durability that is produced by the mechanical graining process when combined with chemical etching. Support G of Comparative Example 2, that is obtained from mechanically grained Support B showing inferiority, exhibits poor stain-resistance and printing durability.

EXAMPLE 7 TO 9 AND COMPARATIVE EXAMPLE 3

Each of Supports A to D as obtained in Examples 1 to 3 and Comparative Example 1 was subjected to chemical etching using a 30% aqueous solution of sodium hydroxide at 60° C. until 6 g/m$^2$ of aluminum was etched. After washing with water, the aluminum sheet was soaked in a 20% aqueous solution of nitric acid to remove any insoluble residue (smut) on the surface followed by washing the water. The surface of the sheet was then subjected to electro-chemical graining in a 0.7% aqueous solution of nitric acid using an alternating wave current as described in U.S. Pat. No. 4,087,341 (corresponding to Japanese Patent Publication No. 19191/80) under electrolysis conditions of $V_A=12.7$ V, $V_C=9.1$ V, and an anodic electric amount of 160 coulomb/ dm$^2$. After removing the smut on the surface, an anodic oxidation film having a thickness of 2 g/m$^2$ was formed in a 20% sulfuric acid aqueous solution.

The resulting supports were designated as Support I, J, K, and L, respectively. Each of the supports was coated with the same light-sensitive composition as used in Example 1 to a dry coverage of 2.5 g/m$^2$ and developed in the same manner as in Example 1. The resulting lithographic printing plate was used for printing in a conventional manner, and the results obtained are shown in Table 3 below.

TABLE 3

| | Example 7 | Comparative Example 3 | Example 8 | Example 9 |
|---|---|---|---|---|
| Support No. | I | J | K | L |
| Printing Durability | 100,000 prints | 80,000 prints | 100,000 prints | 100,000 prints |
| Stain-Resistance of Prints | good | poor | good | good |

It can be seen from Table 3 that a combined graining process comprising mechanical graining, chemical etching, and electro-chemical graining produces lithographic printing plates having further ensured printing durability as compared with the combined process comprising mechanical graining and chemical etching. Support J of Comparative Example 3, that is obtained from mechanical grained Support B showing inferiority, only produces printing plates having poor stain-resistance and printing durability, even when such a combined graining process is adopted.

EXAMPLE 10

A water slurry containing 30% by volume of new abrasive grains of fused alumina having a particle size of #150, sharp-angled tips having a radius of not more than 20 μm, and a specific gravity of 3.98 was spouted to join with a water stream jetted from nozzles fixed at 30-millimeter intervals at a pressure of 30 kg/cm$^2$, and the mixed stream was directed to strike against a surface of a JIS 1050 aluminum web (300 mm in width) at an angle of 50° in a continuous system. Then, the aluminum web was again subjected to the same liquid honing as described above except for changing the striking angle of 130°. The average center-line roughness of the resulting aluminum sheet was 0.55 μm.

The resulting aluminum sheet was soaked in a 2.5% aqueous solution of No. 3 sodium silicate (70° C.) for 20 seconds. The resulting support was designated as Support M.

COMPARATIVE EXAMPLE 4

Support N was produced in the same manner as described in Example 10 except for using abrasive grains that were obtained by making the abrasive grains used in Example 10 to strike against an aluminum sheet 500 times so as to make their tips round. Support N had an average center-line roughness of 0.51 μm.

COMPARATIVE EXAMPLE 5

Support O was produced in the same manner as in Example 10, except for using abrasive grains comprising amorphous $SiO_2$ and having a specific gravity of 2.20 and sharp-angled tips of not more 20 μm in radius. Support O had an average center-line roughness of 0.49 μm.

The same light-sensitive composition as used in Example 3 was coated on each of Supports M to O to a dry coverage of 2.5 g/m$^2$ to form a light-sensitive layer.

Each of the thus prepared presensitized printing plate precursors was exposed to light emitted from a 3 KW metal halide lamp from a distance of 1 m for 50 seconds through a transparent positive film in a vacuum printing frame. The exposed plate was then developed with a 5.26% aqueous solution of sodium silicate ($SiO_2/Na_2O$ molar ratio=1.74; pH=12.7), thoroughly washed with water, and then gummed.

The resulting lithographic printing plates was mounted on a printer, "Sprint 25" manufactured by Komori Insatsuki K.K., to carry out printing. The results obtained are shown in Table 4, in which measurements of "gloss" and evaluation of "stain-resistance" were made in accordance with the footnotes of Table 1.

TABLE 4

| | Example 10 | Comparative Example 4 | Comparative Example 5 |
|---|---|---|---|
| Support No. | M | N | O |
| Abrasive: | | | |
| Specific | | | |

TABLE 4-continued

| | Example 10 | Comparative Example 4 | Comparative Example 5 |
|---|---|---|---|
| Gravity | 3.98 | 3.98 | 2.20 |
| Shape | sharp-angled | round tips | sharp-angled |
| Tip Radius | <20 μm | >20 μm | <20 μm |
| Roughness Bottom Shape | deep- and sharp-cut | shallow and rounded | deep- and short-cut |
| Printing Durability | 40,000 prints | 5,000 prints | 30,000 prints |
| Appearance of Prints (Gloss) | 3.9 | 11.5 | 4.2 |
| Stain-Resistance of Prints | good | poor | good |

As can be seen from the results of Table 4, the effects of abrasive grains having sharp-angled tips can be further heightened by controlling the specific gravity of the abrasive above 2.5.

EXAMPLE 11 AND COMPARATIVE EXAMPLES 6 AND 7

Each of Supports M, N and O as prepared in Example 10 and Comparative Examples 4 and 5 was, after being washed with water, dipped in a 10% aqueous solution of sodium hydroxide heated at 70° C. until 6 g/m$^2$ of aluminum was etched. After washing with water, the aluminum sheet was dipped in a 30% nitric acid aqueous solution for 1 minute for neutralization, followed by thoroughly washing with water. The aluminum sheet was then subjected to anodic oxidation in a 2.0% sulfuric acid aqueous solution by using direct current to form an anodic oxidation film having a weight of 1.5 g/m$^2$. After washing with water, the sheet was dipped in a 2% sodium silicate aqueous solution at 70° C. for 1 minute, washed with water, and dried.

The thus prepared supports were designated as Supports P, Q, and R, respectively. Each of the resulting supports was coated with the same light-sensitive composition as was used in Examples 4 to 6 to a dry coverage of 2.0 g/m$^2$ to form a light-sensitive layer.

Each of the resulting presensitized lithographic printing plates was exposed to light emitted from a 3 KW metal halide lamp from a distance of 1 m for 50 seconds through a transparent negative film in a vacuum printing frame. The exposed plate was developed with the same developer as used in Examples 4 to 6, followed by gumming with an aqueous solution of gum arabic. The resulting printing plate was used for printing in a conventional manner. The results obtained are shown in Table 5.

TABLE 5

| | Example 11 | Comparative Example 6 | Comparative Example 7 |
|---|---|---|---|
| Support No. | P | Q | R |
| Printing Durability | 100,000 prints | 50,000 prints | 90,000 prints |
| Stain-Resistance of Prints | good | poor | good |

The results of Table 5 clearly demonstrate the markedly improved printing durability which is obtained when the mechanical graining is combined with chemical etching and also electro-chemical graining.

EXAMPLE 12 AND COMPARATIVE EXAMPLES 8 AND 9

Each of Supports M, N and Q as obtained in Example 10 and Comparative Examples 4 and 5, after being washed with water, was treated with a 30% sodium hydroxide aqueous solution at 60° C. until 6 g/m$^2$ of aluminum on the surface was etched. After washing with water, the sheet was dipped in a 20% nitric acid aqueous solution to remove any insoluble residue (smut) on the surface, followed by washing with water. The etched aluminum sheet was then subjected to electrochemical graining in a 0.7% nitric acid aqueous solution using an alternative wave current as described in U.S. Pat. No. 4,087,341 under electrolysis conditions of $V_A=12.7$ V, $V_C=9.1$ V, and an anodic electric amount of 160 coulomb/dm$^2$. After removing the smut on the surface, an anodic oxidation film having a thickness of 2 g/m$^2$ was formed in a 20% sulfuric acid aqueous solution. The thus prepared support was designated as Support S, T, or U, respectively.

Onto Support S, T, or U was coated the same light-sensitive composition as used in Example 10 to a dry coverage of 2.5 g/m$^2$, and the resulting presensitized printing plate precursor was exposed and developed in the same manner as in Example 10. Printing was carried out in a usual manner by using the resulting lithographic printing plate. The results obtained are shown in Table 6.

TABLE 6

| | Example 12 | Comparative Example 8 | Comparative Example 9 |
|---|---|---|---|
| Support No. | S | T | U |
| Printing Durability | 110,000 prints | 90,000 prints | 100,000 prints |
| Stain-Resistance of Prints | good | poor | good |

Similar to the results of Example 11, and Comparative Examples 6 and 7, Table 6 shows the effect on printing durability brought about by combining the mechanical graining with chemical etching and also electrochemical graining.

As described above, supports prepared by mechanical graining using abrasive grains with sharp-angled tips having a radius of not more than 20 μm provides lithographic printing plates free from stains and excellent in printing durability and water-retention properties.

These effects can be heightened by combining the above-described mechanical graining with chemical etching, and such improvements can be enhanced further by combining with electro-chemical graining.

When the mechanical graining according to the present invention is carried out by the liquid honing technique comprising jetting a high-pressure liquid from at least one nozzle at a high flow rate, joining a slurry containing the aforesaid abrasive grains with the jetted high-pressure liquid stream, and directing the resulting mixed stream to strike against a surface of an aluminum sheet, the aluminum sheet can be roughened efficiently and surely in mass production.

Further, use of the abrasive grains having not only sharp-angled tips but a specific gravity of at least 2.5 forms a deeper surface roughness having improved adhesion to a light-sensitive layer, to thereby produce lithographic printing plates excellent in stain-resistance and printing durability.

While the invention has been described in detail and with reference to specific embodiments thereof, it will be apparent to one skilled in the art that various changes and modifications can be made therein without departing from the spirit and scope thereof.

What is claimed is:

1. A process for producing a support for lithographic printing plate, which comprises mechanically graining a sheet for the support with abrasive grains which have sharpangled tips having a radius of not more than 20 μm.

2. A process as in claim 1, wherein said abrasive grains have a specific gravity of not less than 2.5.

3. A process as in claim 2, wherein said mechanical graining is followed by at least one of chemical etching and electro-chemical graining.

4. A process as in claim 2, wherein said mechanical graining is carried out by jetting a high-pressure liquid from at least one nozzle at a high flow rate, joining a slurry containing said abrasive grains with the jetted highpressure liquid stream, and directing the resulting mixed stream to strike against a surface of the sheet.

5. A process as in claim 4, wherein said high-pressure liquid is jetted at a flow rate of from 70 to 120 m/sec.

6. A process as in claim 5, wherein said abrasive grains are contained in said slurry in an amount of from 30 to 50% by weight.

7. A process as in claim 5, wherein the resulting mixed stream is directed to strike the surface of the sheet at an angle of from 30° to 150°.

8. A process as in claim 4, wherein the pressure for producing the jetted high-pressure liquid is from 30 to 50 kg/cm$^2$.

9. A process as in claim 4, wherein said abrasive grains are contained in said slurry in an amount of from 30 to 50% by weight.

10. A process as in claim 4, wherein the resulting mixed stream is directed to strike the surface of the sheet at an angle of from 30° to 150°.

11. A process as in claim 1, wherein said mechanical graining is followed by at least one of chemical etching and electro-chemical graining.

12. A process as in claim 1, wherein said mechanical graining is carried out by jetting a high-pressure liquid from at least one nozzle at a high flow rate, joining a slurry containing said abrasive grains with the jetted highpressure liquid stream, and directing the resulting mixed stream to strike against a surface of the sheet.

13. A process as in claim 12, wherein said high-pressure liquid is jetted at a flow rate of from 70 to 120 m/sec.

14. A process as in claim 13, wherein said abrasive grains are contained in said slurry in an amount of from 30 to 50% by weight.

15. A process as in claim 13, wherein the resulting mixed stream is directed to strike the surface of the sheet at an angle of from 30° to 150°.

16. A process as in claim 12, wherein the pressure for producing the jetted high-pressure liquid is from 30 to 50 kg/cm$^2$.

17. A process as in claim 12, wherein said abrasive grains are contained in said slurry in an amount of from 30 to 50% by weight.

18. A process as in claim 12, wherein the resulting mixed stream is directed to strike the surface of the sheet at an angle of from 30° to 150°.

* * * * *